US006418846B1

(12) United States Patent
Hoier

(10) Patent No.: US 6,418,846 B1
(45) Date of Patent: Jul. 16, 2002

(54) ROLLER

(75) Inventor: Günther Josef Hoier, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/763,629

(22) PCT Filed: Sep. 1, 1999

(86) PCT No.: PCT/DE99/02723

§ 371 (c)(1),
(2), (4) Date: Mar. 7, 2001

(87) PCT Pub. No.: WO00/13902

PCT Pub. Date: Mar. 16, 2000

(30) Foreign Application Priority Data

Sep. 7, 1996 (DE) ..... 198 40 806

(51) Int. Cl.[7] ..... B41F 5/00; B41F 9/00

(52) U.S. Cl. ..... 101/216; 101/142; 101/148; 101/348

(58) Field of Search ..... 101/216, 142, 101/148, 348

(56) References Cited

U.S. PATENT DOCUMENTS

| | | | | |
|---|---|---|---|---|
| 4,429,630 A | * | 2/1984 | Hajek | 101/216 |
| 5,025,723 A | * | 6/1991 | Abendroth et al. | 101/148 |
| 5,027,704 A | * | 7/1991 | Holl et al. | 101/148 |
| 5,103,726 A | | 4/1992 | Wieland | |
| 5,511,474 A | * | 4/1996 | Junghans | 101/348 |
| 5,619,922 A | * | 4/1997 | Kelm | 101/216 |
| 5,713,280 A | * | 2/1998 | Kelm et al. | 101/142 |

FOREIGN PATENT DOCUMENTS

| | | |
|---|---|---|
| DE | 1 240 888 | 2/1959 |
| DE | 40 13 416 C1 | 11/1991 |
| EP | 0 454 010 A1 | 10/1991 |

* cited by examiner

*Primary Examiner*—Andrew H. Hirshfeld
*Assistant Examiner*—Marvin P. Crenshaw
(74) *Attorney, Agent, or Firm*—Jones, Tullar & Cooper, PC

(57) ABSTRACT

A friction roller is connected, in an articulated manner, in the area of its axis of rotation, to one end of a connecting rod. The second end of this connecting rod is connected, in an articulating manner, to a peripheral portion of a rotatable lever that can be driven. A rotational axis of the lever is situated at an angle with respect to the rotational axis of the friction roller.

9 Claims, 1 Drawing Sheet

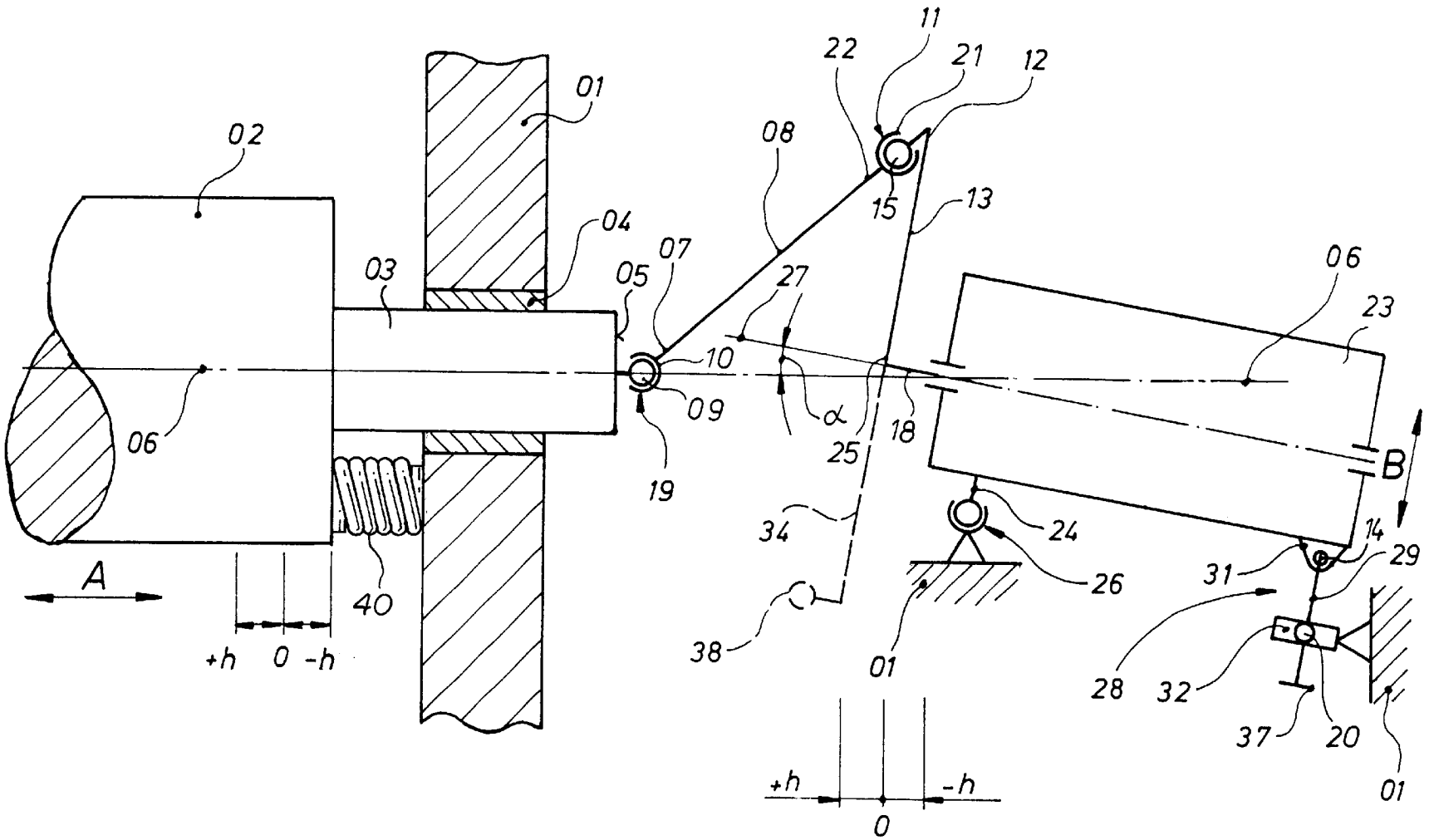
01
02
03
04
05
06
07
08
09
10
11
12
13
14
15
18
19
20
21
22
23
24
25
26
27
28
29
31
32
34
37
38
40
A
B
α
-h
0
+h

ROLLER

FIELD OF THE INVENTION

The present invention relates to a roller for a rotary printing press. The roller is connected by a coupler to a drive mechanism in an eccentric fashion.

DESCRIPTION OF THE PRIOR ART

An arrangement for the axial back-and-forth movement of an ink roller and having a device for changing the axial lift is disclosed in DE-PS 12 40 888.

SUMMARY OF THE INVENTION

The object of the present invention is directed to creating a roller which can be reciprocally moved in the axial direction.

In accordance with the present invention, this object is attained by the provision of a roller which is connected to a drive mechanism by a coupler. The coupler is hingedly seated and is connected eccentrically with the drive mechanism. The number of revolutions of the drive, and the number of revolutions of the roller can be changed in relation to each other.

The advantages which can be achieved by the present invention lie, in particular, in that the lift frequency and/or the lift length can be selectively set during the operation.

BRIEF DESCRIPTION OF THE DRAWING

A preferred embodiment of the present invention is represented in the sole drawing FIGURE and will be described in greater detail in what follows.

The sole drawing FIGURE represents a schematic lateral view of the reciprocally movable roller with its lifting drive mechanism in accordance with the present invention.

DESCRIPTION OF THE PREFERRED EMBODIMENT

Both roller journals 03 of a driveable roller 02, for example a friction roller, are rotatably and axially displaceably arranged in two lateral frames 01. Only one lateral frame 01 is shown in the drawing. The desired lift or lateral displacement ±h of, for example ±25 mm in a direction of the axis of rotation 06 of the roller 02, can be set either in steps or in an infinitely variable manner.

Bearings 04, for example sliding bearings, are provided in bores in the lateral frames 01 for seating and slidably supporting the roller journals 03.

A journal joint 19, for example with a play or degrees of freedom, "f" of "f'=4, is attached, in the area of the axis of rotation 06 of the roller journal, 03 to the end of one of the roller journals 03, for example at a front face 05 of the end of the roller journal 03. The journal joint 19 is embodied, for example, as a traction- and shear- resistant ball tube joint. The spherical gudgeon 09 of joint 19 is attached at the front face 05 of the journal 03, and the spherical liner 10 of joint 19 is attached at a first end 07 of a bending-resistant coupling rod 08.

A spherical liner 21 is attached at a second end 22 of the bending-resistant coupling rod 08.

A drive joint 11, for example with a play or degrees of freedom "f" of "f'=4, is provided at an outer end 12 of a rotatable, drive member such as a driveable one-armed drive lever 13, or at an outer end of a radius of a drive disk. The drive joint 11 is embodied, for example, as a traction- and shear-resistant ball tube joint. Its spherical gudgeon 15 is seated on the outer end 12 of the drive lever 13 and is interlockingly connected with the spherical liner 21.

An inner end 25 of the drive lever 13 is fastened, fixed against relative rotation, on a shaft 18 of a drive mechanism 23. Shaft 18 rotates around its axis of rotation 27. Drive mechanism 23 may be, for example, an rpm- controlled electric motor 23. In this case, the shaft 18 can be the driveshaft of an electric motor 23.

The axes of rotation 06 of the roller 02 and 27 of the electric motor 23 can be aligned with each other in such a way that, in a first extreme case, they coincide, and in a second extreme case they enclose an angle $\alpha$, of, for example, 30°. The angle $\alpha$ can be set in steps or in an infinitely variable manner and can be maintained in a desired position.

Setting of the angle a can take place directly by tilting the drive mechanism, the drive motor 23 in the preferred embodiment. To this end, feet are provided, for example on the bottom of the drive motor 23, at the front near the driveshaft 18. These feet are fastened on a rocker 24. The rocker 24 is pivotably connected with the lateral frame 01 by means of a link, for example a hinge 26 with a degree of freedom "f'=1. The members of the hinge 26 are interlockingly connected in such a way that lateral tilting in the course of their force transmission is not possible.

Moreover, a rear, or remote from the driveshaft, bearing 31 in the form of an eye is provided on the bottom of the drive motor 23, which rear bearing 31 is hingedly connected with a fork head 14 of a linear drive mechanism 28.

The linear drive mechanism 28 can consist, for example, of a threaded spindle 29, which can be driven in either of its two directions manually or by a motor and whose upper end is rotatably joined to the fork head 14. The thread of the threaded spindle 29 is in engagement with an inner thread of a threaded nut 20. The threaded nut 20 is fastened in a nut holder 32 fixed in place on the lateral frame 01.

Pivoting of the drive mechanism 23, and therefore of the drive element - i.e. the one-armed lever 13 -, in the desired direction takes place by an appropriate actuation of the linear drive mechanism 28. If the threaded spindle 29 is turned to the left or to the right, the rear end of the drive mechanism 23 is raised or lowered, and the one-armed lever 13 is also pivoted because of this. The one-armed lever exerts pressure or traction on the coupling rod 08, and therefore on the roller journal 03.

Thus, turning the threaded spindle 29 results in a corresponding change of the lift or the lateral displacement h of the roller journal 03 and of the roller 02.

The lift or lateral displacement ±h becomes zero as soon as the drive 23 is no longer operating or the angle a equals zero.

The lever 13 can be embodied as a one-armed lever 33 or as a two-armed lever 34, as depicted in dashed lines in the sole drawing figure. An outboard end of the second or free end of the two-armed lever 34 can be provided with a compensating weight 38. It is also possible to provide a rotating disk in place of the lever 13.

The drive mechanism 23, for example an electric motor, is designed as an rpm-controlled or regulated drive mechanism for being able to set the lift or the lateral displacement frequency. If the number of revolutions of the drive mechanism 23 is increased, the lift frequency is proportionally increased is reduced, the lift frequency is reduced proportionally with it. If the drive mechanism 23 is switched off, the friction roller 02 no longer performs a lift; i.e. it no longer moves laterally along its axis of rotation.

In accordance with one variation, it becomes additionally possible to arrange an energy storage device, for example a compression spring 40 between the lateral frame 01 and a right end face of the friction roller 02. Because of this, the coupling rod 08 is only stressed by traction. This occurs when the friction roller 02 moves from the left to the right, as shown in the drawing, and the compression spring 40 is compressed in the process. With a subsequent movement of the friction roller from the right to the left, the compression spring relaxes again and releases its stored energy.

It is also possible to arrange a compression spring between a left front face of the friction roller 02 and a left lateral frame. This results in the coupling rod 08 only being stressed by pressure.

While a preferred embodiment of a roller in accordance with the present invention has been set forth fully and completely hereinabove, it will be apparent to one of skill in the art that various changes in, for example the overall size of the roller, the specific type of sliding bearing used, and the like can be made without departing from the true spirit and scope of the present invention which is accordingly to be limited only by the following claims.

What is claimed is:

1. A laterally shiftable roller assembly comprising:

a roller;

roller journals supporting said roller for lateral shifting and for rotation about a roller axis of rotation;

a drive mechanism useable to shift said roller laterally, said drive mechanism having a drive mechanism axis of rotation;

a coupler extending between said roller and said drive mechanism, said coupler having a first end connected to said roller journal and having a second end connected to said drive mechanism offset from said drive mechanism axis of rotation wherein rotation of said drive mechanism causes said roller to shift laterally along said roller axis of rotation and further wherein a number of revolutions of said drive mechanisms and a number of revolutions of said roller can be changed in relation to each other; and means supporting said drive mechanism for pivotal movement with respect to said roller axis of rotation to shift said drive mechanism axis of rotation relative to said roller axis of rotation to vary an amount of said lateral shifting of said roller.

2. The roller assembly of claim 1 further wherein said drive mechanism has a shaft with a shaft axis of rotation, said roller axis of rotation and said shaft axis of rotation intersecting at an acute angle.

3. The roller assembly of claim 2 wherein said acute angle is variable.

4. A laterally shiftable roller assembly comprising:

a roller;

roller journals supporting said roller in lateral frames for lateral shifting of said roller and for rotation of said roller about a roller axis of rotation;

a drive mechanism, said drive mechanism being useable to accomplish said lateral shifting of said roller, said drive mechanism having a drive mechanism axis of rotation and having a variable speed of rotation;

a drive member, said drive member having a first end connected to, and driven by said drive mechanism, said drive member acting as a drive lever;

a coupling rod, said coupling rod having a first end connected to one of said roller journals and having a second end connected to said drive member remote from said drive member first end, said drive mechanism and said drive member generating a rotating movement of said coupling rod about said roller axis of rotation; and means supporting said drive mechanism for pivotable movement with respect to said roller axis of rotation, said pivotable movement of said drive mechanism shifting said drive mechanism axis of rotation with respect to said roller axis of rotation to vary an amount of said lateral shifting of said roller.

5. The roller assembly of claim 4 wherein said drive member is selected from the group including a one-armed lever, a two-armed lever and a disk.

6. The roller assembly of claim 5 wherein said drive member is a disk secured to said drive mechanism.

7. The roller assembly of claim 4 further including a spring force storage device positioned between a front end face of said roller and one of said lateral frames.

8. A laterally shiftable roller assembly comprising:

a roller;

roller journals supporting said roller in lateral frames for lateral shifting and for rotation about a roller axis of rotation;

a drive mechanism useable to shift said roller laterally, said drive mechanism having a shaft with a shaft axis of rotation and having an adjustable number of revolutions, said roller axis of rotation and said shaft axis of rotation intersecting at an acute angle;

a drive member driven by said drive mechanism, said drive member acting as a drive lever;

a coupling rod having a first end connected to one of said roller journals and having a second end connected to said drive member, said drive mechanism generating a rotating movement of said coupling rod about said roller axis of rotation; and means supporting said drive mechanism for pivotable movement with respect to said roller axis of rotation.

9. The roller assembly of claim 8 wherein said acute angle is variable.

* * * * *